US009441886B2

(12) United States Patent
Moller et al.

(10) Patent No.: US 9,441,886 B2
(45) Date of Patent: Sep. 13, 2016

(54) WORK LOAD LIFTING SYSTEM FOR A VERTICAL VACUUM FURNACE

(71) Applicant: IPSEN, INC., Cherry Valley, IL (US)

(72) Inventors: Craig A. Moller, Roscoe, IL (US); Jake Hamid, Oakwood Hills, IL (US)

(73) Assignee: IPSEN, INC., Cherry Valley, IL (US)

( * ) Notice: Subject to any disclaimer, the term of this patent is extended or adjusted under 35 U.S.C. 154(b) by 737 days.

(21) Appl. No.: 13/728,113

(22) Filed: Dec. 27, 2012

(65) Prior Publication Data

US 2013/0209947 A1 Aug. 15, 2013

Related U.S. Application Data

(60) Provisional application No. 61/581,298, filed on Dec. 29, 2011.

(51) Int. Cl.

| | |
|---|---|
| ***F27B 1/20*** | (2006.01) |
| ***F27D 3/12*** | (2006.01) |
| ***F27B 1/24*** | (2006.01) |

(Continued)

(52) U.S. Cl.

CPC ..... *F27B 1/20* (2013.01); *C21D 9/0018* (2013.01); *F27B 1/24* (2013.01); *F27B 5/12* (2013.01); *F27B 5/13* (2013.01); *F27B 11/00* (2013.01);

(Continued)

(58) Field of Classification Search

CPC ..... F27B 1/26; F27B 9/142; F27B 17/0033; F27B 17/005; F27B 17/0058; F27B 2007/3223; F27B 17/00; F27D 2003/125; F27D 2003/126; F27D 2003/127; F27D 2003/128; F27D 3/12; B65G 27/02; B65G 33/06; B65G 33/38; B65G 35/063; B65G 35/066; B30B 1/18; B30B 1/181; B30B 7/02; B30B 7/026; B30B 7/00; B66F 2700/04; B66F 7/025; B66F 7/14; B66F 3/08

USPC ..... 432/241, 45

See application file for complete search history.

(56) References Cited

U.S. PATENT DOCUMENTS 3,920,364 A * 11/1975 Cadogan-Rawlinson B30B 1/34 100/214

4,077,528 A * 3/1978 Santen ..... A23L 3/001 198/663

(Continued)

FOREIGN PATENT DOCUMENTS

KR 20090112407 A * 10/2009

*Primary Examiner* — Steven B McAllister

*Assistant Examiner* — Steven Anderson, II

(74) *Attorney, Agent, or Firm* — Dann, Dorfman, Herrell and Skillman, P.C.

(57) ABSTRACT

A lifting apparatus for a vertical vacuum furnace is disclosed. The apparatus includes first and second support modules arranged in spaced parallel alignment and first and second reversible lifting mechanisms mounted on respective ones of the first and second support modules. The apparatus also includes first and second motive means coupled to the first and second reversible lifting mechanisms for driving the reversible lifting mechanisms. First and second trolleys are operatively connected to the first and second reversible lifting mechanisms and adapted for engaging with a payload. The apparatus further includes a control system connected to the first and second motive means for controlling the operation of the first and second reversible lifting mechanisms whereby the first and second trolleys can be raised or lowered. A vertical vacuum furnace assembly including the lifting apparatus is also disclosed as well as a support module and a bottom head assembly for the lifting apparatus.

14 Claims, 8 Drawing Sheets

(51) Int. Cl.

| | |
|---|---|
| ***F27D 3/02*** | (2006.01) |
| ***C21D 9/00*** | (2006.01) |
| ***F27B 5/12*** | (2006.01) |
| ***F27B 5/13*** | (2006.01) |
| ***F27B 11/00*** | (2006.01) |
| *C21D 1/74* | (2006.01) |

(52) U.S. Cl.
CPC ..... *F27D 3/026* (2013.01); *F27D 3/12* (2013.01); *C21D 1/74* (2013.01); *C21D 9/0043* (2013.01)

(56) References Cited

U.S. PATENT DOCUMENTS 6,164,961 A * 12/2000 Luscher ..... A21B 1/42 198/465.1
7,365,287 B1 * 4/2008 Ellis ..... F27B 1/005 219/388
7,371,998 B2 * 5/2008 Harris ..... F27B 17/0025 118/724
7,381,052 B2 * 6/2008 Zhao ..... H01L 21/67109 118/724
2001/0001468 A1 * 5/2001 Blohmann ..... B23K 1/008 228/49.1
2001/0038786 A1 * 11/2001 Kim ..... B62B 1/002 414/490
2001/0050212 A1 * 12/2001 Nakatsukasa ..... F27D 3/0024 198/736
2011/0279347 A1 * 11/2011 Pass ..... H01Q 1/1242 343/890
2012/0152879 A1 * 6/2012 Glickman ..... B66C 19/007 212/291

* cited by examiner

WORK LOAD LIFTING SYSTEM FOR A VERTICAL VACUUM FURNACE

CROSS REFERENCE TO RELATED APPLICATION

This application claims the benefit of U.S. Provisional Application No. 61/581,298, filed Dec. 29, 2011, the entirety of which is incorporated herein by reference.

BACKGROUND OF THE INVENTION

1. Field of the Invention

This invention relates to vacuum heat treating furnaces and in particular to a vertically-oriented vacuum furnace and an apparatus for lifting a work load into the vacuum furnace and lowering therefrom.

2. Description of the Related Art

Industrial vacuum heat treating furnaces having either a horizontal configuration or a vertical configuration are known. In a vacuum furnace having a horizontal configuration, a work load of parts to be heat treated is transported into the furnace chamber with an apparatus that provides horizontal translation of the work load. In a vacuum furnace having a vertical configuration, a lifting apparatus is used to raise the work load from the factory floor up to the furnace chamber which is elevated.

A known arrangement for a lifting system for a vertical vacuum furnace utilizes a four-point lifting apparatus. The apparatus typically includes four ball screws that operated synchronously so that the work load is lifted evenly. In order to keep the ball screws in synchronism with each other, multiple gear boxes and connecting shafts with couplings are utilized. The known designs for such lifts were composed of many parts that had to be assembled and aligned at the manufacturing site, and then disassembled for shipment. When the furnace arrives at the customer site, the lift apparatus must be re-assembled and aligned again. That is a time consuming process that usually adds several days to the delivery time schedule.

The gear boxes, drive shafts, and couplings used in the known lift mechanisms generate a considerable amount of noise when operating to lift or lower a work load. The couplings that connect the drive shafts, motor shafts, gear box shafts, and the ball screw shafts become loosened over time. When that occurs, it causes one or more of the ball screws to become un-synchronized with the other ball screw(s). Such out-of-synch operation can cause catastrophic damage to the lifting mechanism. If the ball screws get too far out-of-synch, the work load itself and even the hot zone inside the furnace can be damaged.

The known lift mechanisms for vertical vacuum furnaces have lifting points that contact the bottom lifting structure of the furnace through coil springs. The lift mechanism is operated to lift the bottom door toward the furnace until a mechanical limit switch is tripped, thereby providing an indication that the lifting structure was in its final, fully-lifted position. In the final lifted position, the springs are compressed a small amount as the bottom lifting structure contacts the upper part of the furnace vessel. If the mechanical switch is not adjusted properly or becomes out-of-adjustment, the springs over-compress and the lifting structure and door can be subject to bending damage.

In view of the foregoing problems with the known lifting systems for vertical vacuum furnaces it would be desirable to have a lifting apparatus for a vertical vacuum furnace that overcomes the problems associated with the known lifting systems.

SUMMARY OF THE INVENTION

The lifting system for a work load into a vertical vacuum furnace in accordance with the present invention includes two ball screws each driven by a servo-type motor and synchronized with each other through an electrical servo drive system using encoders and/or resolvers to provide position feedback. Each ball screw is constructed and arranged to lift or lower an elevator that is guided in tracks. The elevator system with ball screw and motor are assembled into the leg structure of the vertical furnace. This leg/elevator/ball screw/motor combination is a modular assembly that remains intact for shipment and installation at the end user's site.

The movement of the lifting elevator is very quiet because there are no gear boxes, shafts, and couplings. Each servo motor is directly coupled to a respective ball screw. The servo drive system can be programmed for acceleration and deceleration of the elevator movement near the end of its travel. This allows for the elimination of the springs between the lifting structure and the pick-up points of the elevator. Encoder feedback precisely locates the elevators in either the full up or full down positions.

Another beneficial feature of the lift system according to this invention is that the ball screw attachment point on the elevator mechanism has a jointed linkage that allows for misalignment with little or no stress to the ball screw.

BRIEF DESCRIPTION OF THE DRAWINGS

The foregoing summary as well as the following detailed description will be better understood when read with reference to the drawing views, wherein.

DETAILED DESCRIPTION OF THE INVENTION

Figure 1:
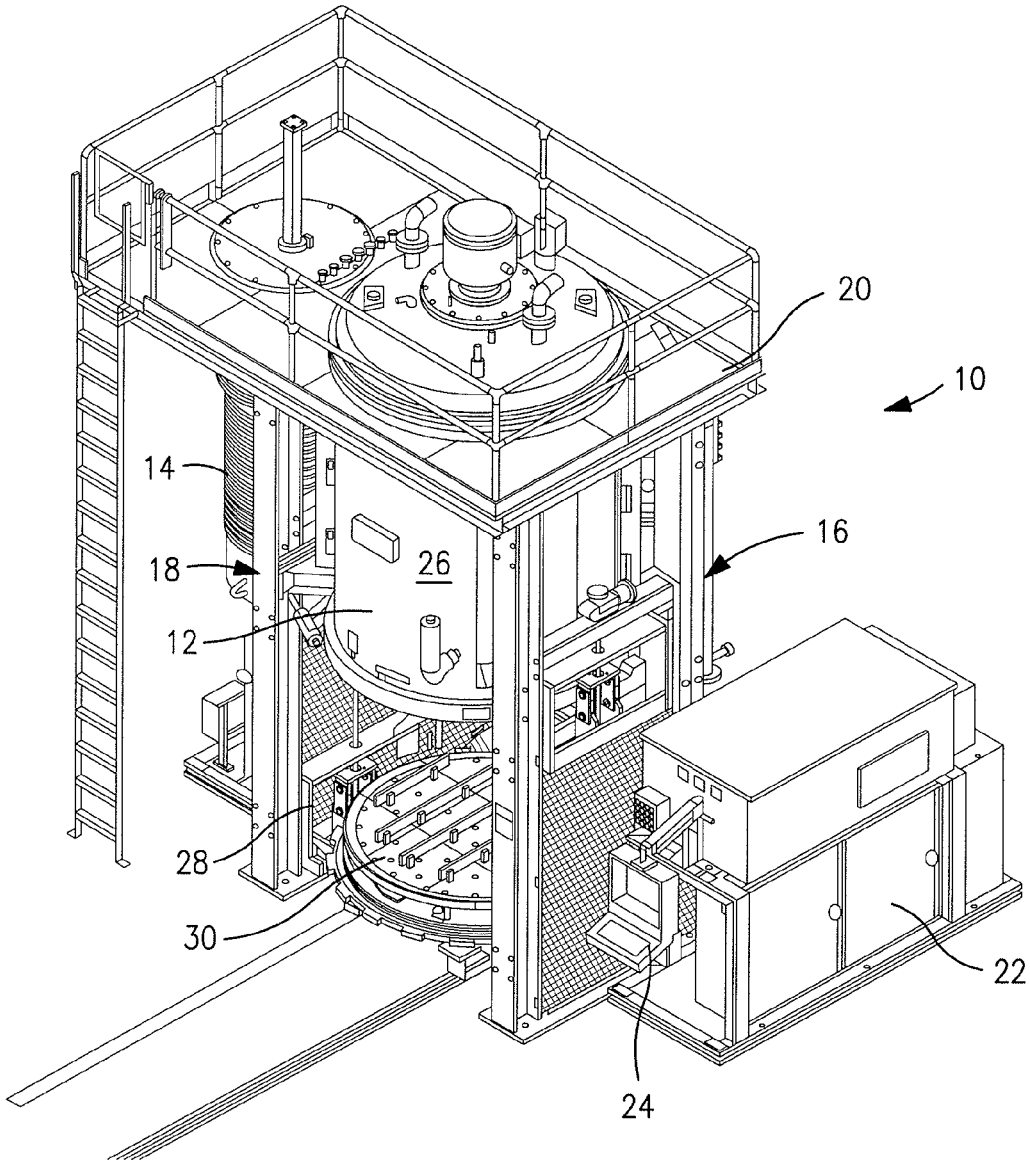
FIG. 1 is a perspective view of a vertical vacuum furnace assembly in accordance with the present invention.
Figure 2:
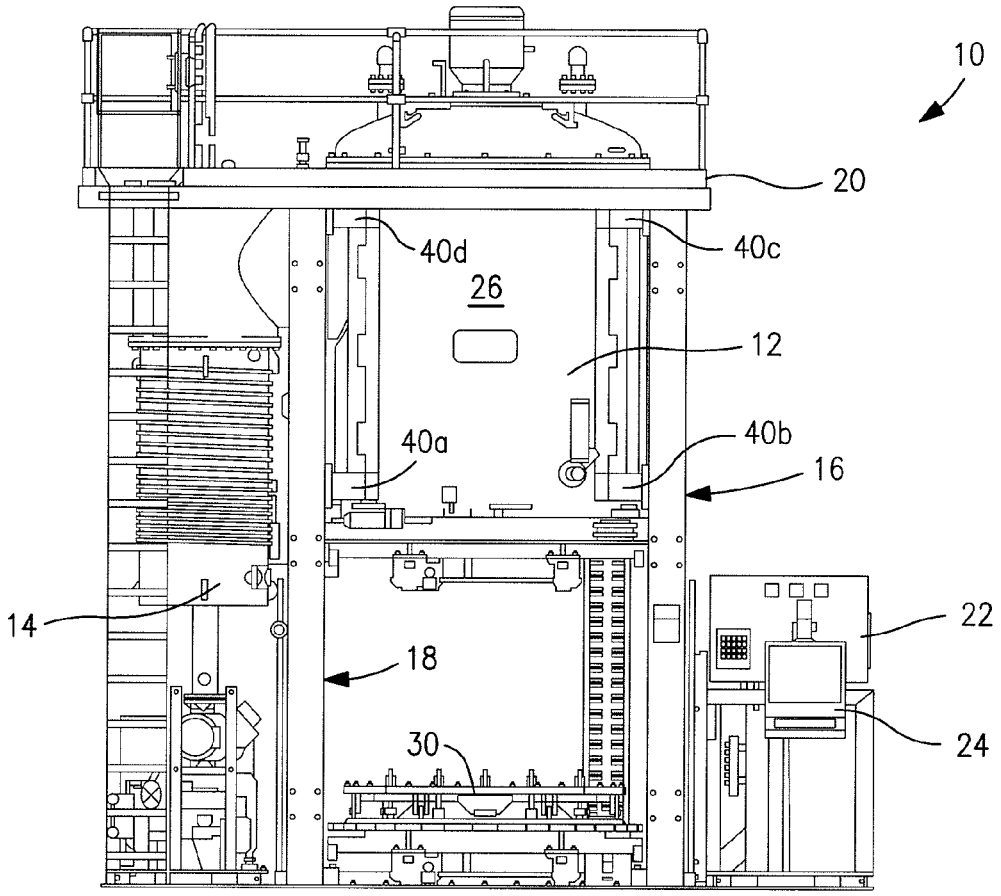
FIG. 2 is a front elevation view of the vertical vacuum furnace assembly of FIG. 1.

Referring now to the drawings and in particular to FIGS. 1 and 2, there is shown a vacuum furnace 10 in accordance with the present invention. The vacuum furnace 10 has a vertical orientation and is elevated relative to the floor of the facility in which the vacuum furnace is located. The vacuum furnace 10 includes a pressure/vacuum vessel 12 and a vacuum pump 14. The pressure/vacuum vessel 12 is supported by a pair of leg assemblies including, a first leg assembly 16 and a second leg assembly 18. A service platform 20 is mounted at the upper ends of leg assemblies 16 and 18. A control cabinet 22 and a control console 24 are provided, preferably adjacent to the vacuum furnace 10.

The pressure/vacuum vessel 12 includes a body 26 having an opening 28 at the lower end of the body. The pressure/vacuum vessel 12 also has a bottom head assembly 30 that is movable for closing the opening 28 when the vacuum furnace is to be operated for heat treating a work load of metal parts. The body 26 of pressure/vacuum vessel 12 is mounted on the leg assemblies 16 and 18 with a plurality of support arms. Support arms 40*a*, 40*b*, 40*c*, and 40*d* are provided to attach the front portion of pressure vessel body 26 to the front portions of leg assemblies 16 and 18. A similar group of support arms (not shown) are provided to attach the rear portion of pressure vessel body 26 to the rear portions of the leg assemblies 16 and 18.

Figure 3:
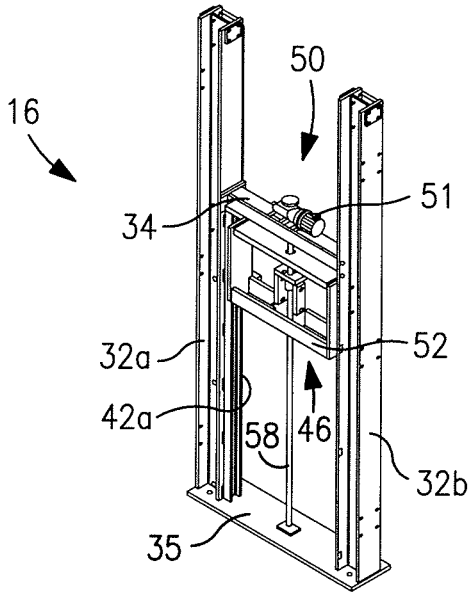
FIG. 3 is a perspective view of a leg assembly used in the vertical vacuum furnace assembly of FIG. 1.
Figure 4:
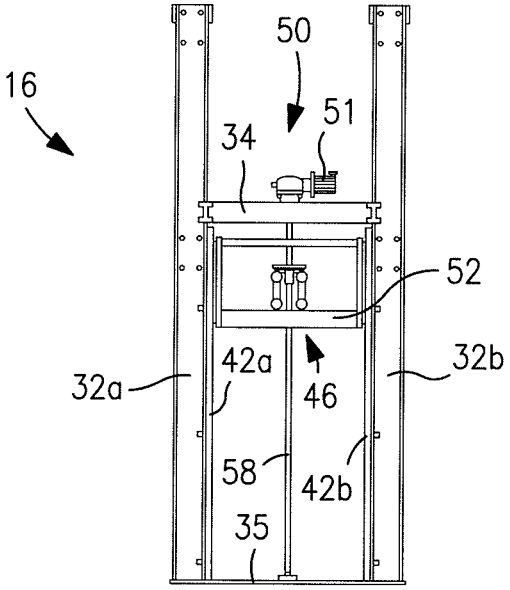
FIG. 4 is a rear elevation view of the leg assembly of FIG. 3.

Referring now to FIGS. 3 and 4, there is shown in greater detail the construction of the leg assembly 16. Leg assembly 18 is constructed and arranged essentially the same as leg assembly 16. Therefore, only leg assembly 16 will be described.

Leg assembly 16 includes a pair of support columns 32*a* and 32*b*. The support columns 32*a* and 32*b* are connected together with a cross beam 34 and a floor plate 35. The floor plate 35 is attached to the bottoms of support columns 32*a* and 32*b*, preferably by being welded thereto. The cross beam 34 is attached between the columns 32*a* and 32*b* at a location that is intermediate to the bottom ends and the top ends of support columns 32*a* and 32*b*

Figure 10:
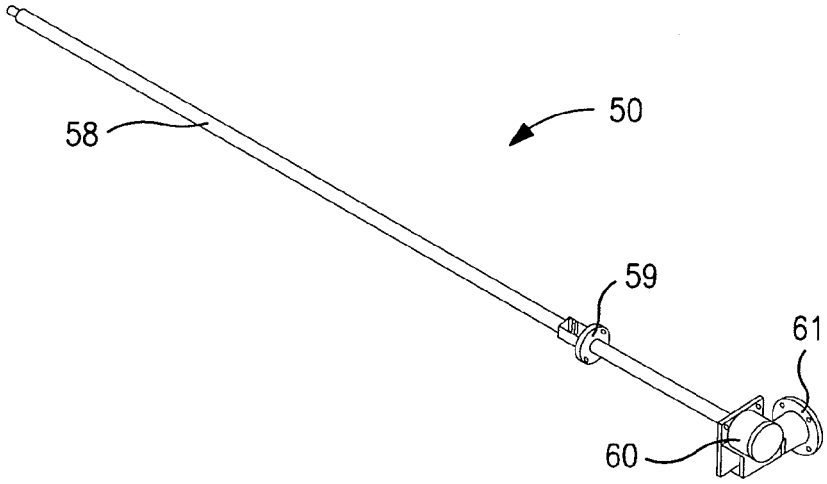
FIG. 10 is perspective view of ball screw jack used in the leg assembly of FIG. 3.
Figure 11:
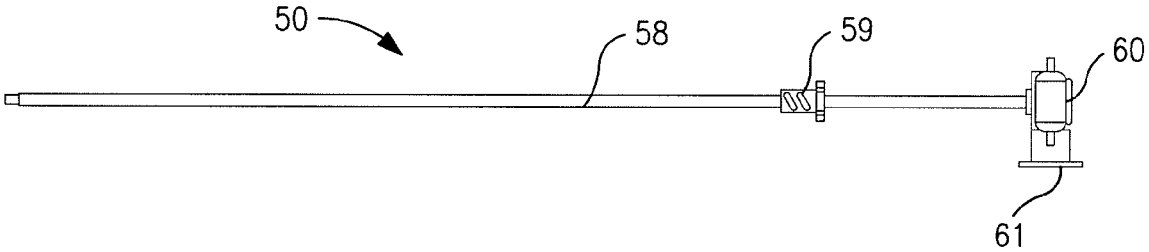
FIG. 11 is an elevation view of the ball screw jack of FIG. 10.

Leg assembly 16 also includes an elevator mechanism 46 that is configured for lifting or lowering the bottom head assembly 30 relative to the pressure vessel body. The elevator mechanism 46 includes a mechanical lifting device, preferably a ball-screw jack 50, and a lifting trolley 52 that is operatively coupled to the lifting device. Guide channels 42*a* and 42*b* are formed or mounted on facing surfaces of columns 32*a* and 32*b*, respectively. The guide channels 42*a* and 42*b* provide tracks for the lifting trolley to move in, along the leg assembly 16. The ball-screw jack 50, shown in greater detail in FIGS. 10 and 11, includes a threaded shaft 58 and a ball nut 59 in accordance with the known construction. A drive gear box 60 is coupled to the threaded shaft 58 at one end thereof. The drive gear box 60 includes a motor mount 61 for attaching an electric drive motor 51 thereto. It will be appreciated by those skilled in the art that a machine-screw jack can be used instead of the ball screw jack shown in FIGS. 10 and 11.

Figure 8:
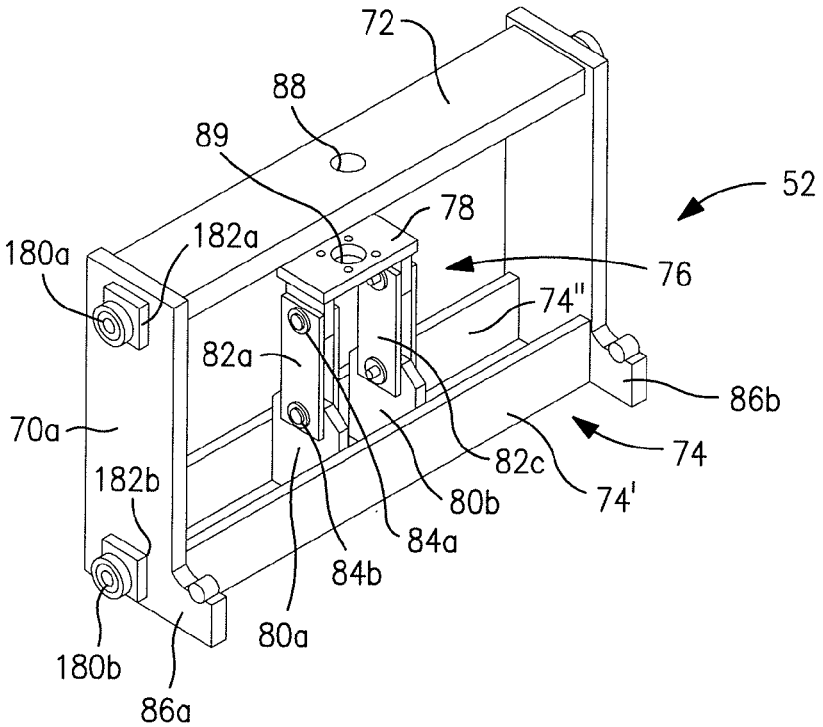
FIG. 8 is a front perspective view of an elevator trolley used in the leg assembly of FIG. 3.
Figure 9:
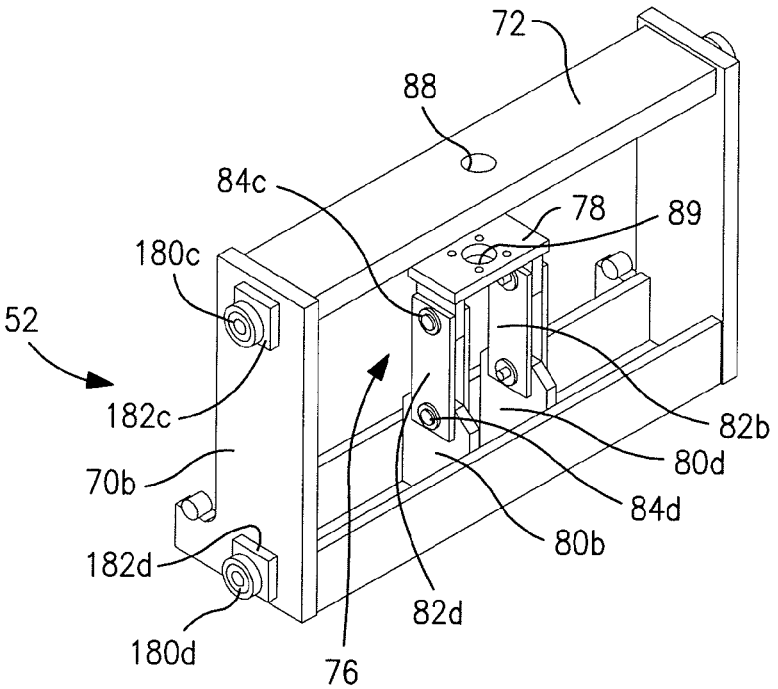
FIG. 9 is a rear perspective view of the elevator trolley of FIG. 8.

Referring now to FIGS. 8 and 9 of the drawing, the lifting trolley 52 includes a pair of L-shaped side plates 70*a* and 70*b*. The side plates are connected together with an upper cross beam 72 and a lower cross bar 74. In the embodiment shown, the lower cross bar 74 is formed of a pair of bars 74', 74" in spaced parallel relation to each other. The upper cross beam 72 has an opening 88 formed therethrough at a location that is preferably midway between the side plates 70*a*, 70*b*. The opening 88 is dimensioned and position so that the threaded shaft 58 of the ball-screw jack 50 can pass therethrough. The lifting trolley 52 includes a ball-screw attachment assembly 76 for coupling the ball-screw jack 50 to the trolley 52. Lift bars 80*a* and 80*b* are mounted between the bars 74', 74" of lower cross bar 74. A bracket 78 is provided for connecting the ball-screw jack 50 to the lifting trolley 52. As shown in the embodiment of FIGS. 8 and 9, the bracket 78 includes a mounting plate 79 that has a central opening 89 and plurality of bolt-holes. The central opening is dimensioned to permit the threaded shaft 58 of the ball-screw jack 50 to pass through the lifting trolley 52. The bolt-holes are provided for attaching the ball nut 59 of the ball-screw jack 50 to the bracket 78.

The bracket 78 is coupled to the lifting bars 80*a* and 80*b* by means of link bars 82*a*, 82*b*, 82*c*, and 82*d*. The link bars 82*a* and 82*b* are pivotally connected between lift bar 80*a* and the bracket 76 with pivot pins 84*a* and 84*b*. Link bars 82*c* and 82*d* are pivotally connected between lift bar 80*b* and bracket 76 with pivot pins 84*c* and 84*d*. The jointed linkage provided by the link bars between the lift bars and the mounting bracket prevents significant lateral stress to the ball-screw jack when minor misalignment of the elevator trolley and the ball-screw shaft occurs.

Guide wheels or bearings 180*a* and 180*b* are provided on the outward facing surface of end plate 70*a*. In like manner, guide wheels 180*c* and 180*d* are provided on the outward facing surface of end plate 70*b*. The guide wheels 180*a* and 180*b* are affixed to end plate 70*a* on mounting pads 182*a* and 182*b*, respectively. Similarly, guide wheels 180*c* and 180*d* are affixed to end plate 70*b* on mounting pads 182*c* and 182*d*, respectively. The guide wheels 180*a*-180*d* are dimensioned and arrange to fit and travel in the guide channels 42*a* and 42*b* of leg assembly 16.

End plates 70*a*, 70*b* are L-shaped and include feet 86*a* and 86*b* which extend laterally. The feet 86*a* and 86*b* are constructed and arranged to engage with the support structure for the bottom head assembly of the pressure/vacuum vessel as described in greater detail below.

As will be apparent to those skilled in the art, the construction features of leg assemblies 16 and 18 provide the advantage that they can be preassembled as modules prior to shipment with the vacuum furnace. The ability to ship the leg assemblies as preassembled modules significantly reduces the time needed to ship the vacuum furnace and assemble the vacuum furnace at the user's facility. Moreover, it is also apparent from the foregoing description, that there is no mechanical linkage required between the lifting mechanisms on each leg assembly. Thus, the modular construction of the leg assemblies 16 and 18 avoids the need for the installation of such linkage and the need for proper alignment and realignment of the lifting mechanisms and the linkage that is necessary in the known lift mechanisms. The omission of the multiple gear boxes, drive shafts, and couplings that are usually part of the mechanical linkage between the lifting mechanisms, also results in significantly quieter operation.

Figure 5:
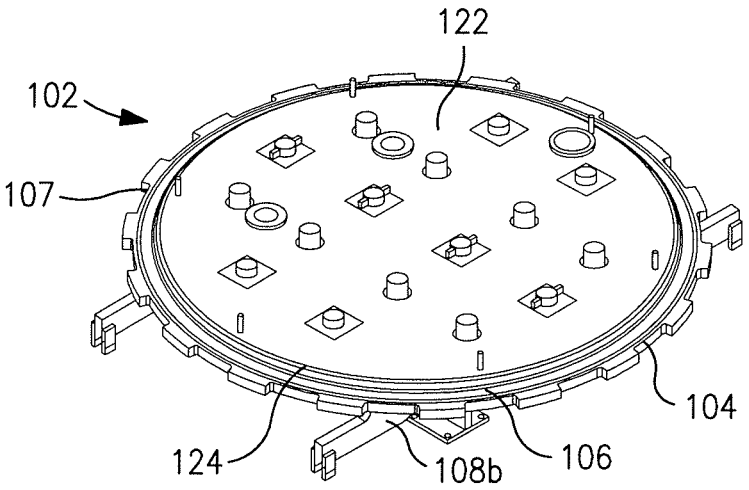
FIG. 5 is a perspective view of a bottom head assembly used in the vertical vacuum furnace of FIG. 1.
Figure 6:
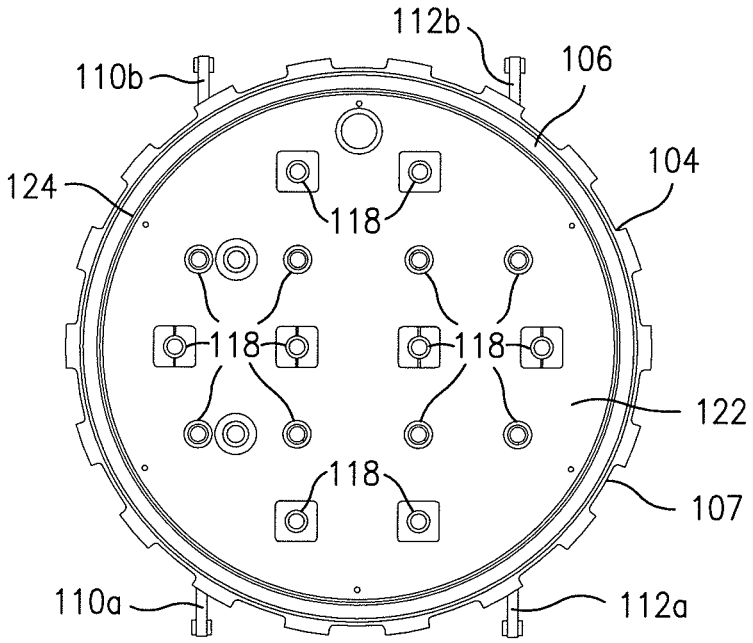
FIG. 6 is a top plan view of the bottom head assembly of FIG. 5.
Figure 7:
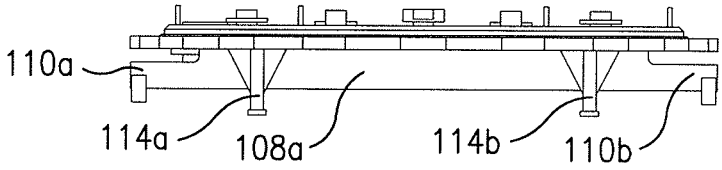
FIG. 7 is a front elevation view of the bottom head assembly of FIG. 5.

Referring now to FIGS. 5, 6, and 7, there is shown a preferred embodiment of a bottom head for the pressure/vacuum vessel 12. The bottom head assembly 102 has a generally flat profile for compactness. The bottom head 102 includes a generally round plate 104 that is dimensioned to cover the opening in the bottom of the pressure vessel body. The plate 104 is preferably formed with a peripheral groove that receives a sealing ring 107. A flange 106 is formed around the circumference of the plate 104 and is dimensioned and arranged to engage with a corresponding, mating flange about the opening 28 in the pressure/vacuum vessel body 26. The flat bottom head arrangement is suitable when high gas quenching pressures, i.e., gas pressures greater than about 2 bar, are not used in the vacuum furnace. Therefore, when gas quenching pressures greater than about 2 bar are used, a conventional dished or domed bottom head must be used to meet the requirements of the pressure vessel code.

A pair of support beams, 108*a* and 108*b*, are attached to the exterior of the plate 104 and extend transversely across the plate in spaced parallel relation. The support beams have portions that extend beyond the plate 104. In particular, support beam 108*a* has extension portions 110*a* and 110*b* and support beam 108*b* has extension portions 112*a* and 112*b*. The extension portions, 110*a* and 110*b* are constructed for engaging with the feet, 86*a* and 86*b*, of the lifting trolley 52. The extension portions, 112*a* and 112*b*, are similarly constructed to engage with the corresponding feet of the lifting trolley on leg assembly 18. As seen in FIG. 7, support legs, 114*a* and 114*b*, extend vertically from the exterior side of plate 104. A second pair of support legs is provided behind and spaced from support legs 114*a* and 114*b*, but are not shown in FIG. 7. The support legs are constructed and arranged to add stiffness to the plate and to support the bottom head assembly 102 when it is resting on the floor. The support legs are dimensioned to provide sufficient height above the floor so that the lifting trolleys can readily engage with the extension portions 110*a*, 110*b*, 112*a*, and 112*b* of the support beams 108*a* and 108*b*.

A plurality of sockets or receptacles 118 are arranged and affixed in the central area of the interior side of plate 104. The receptacles 118 extend vertically and are dimensioned to receive the posts that support the furnace hearth rails (see, FIG. 1 for example). A cover plate 122 is mounted on the interior side of the plate 104 to cover the central area plate. The cover plate 122 sits on and is attached to a spacer ring 124 that is affixed to the inside surface of plate 104. The cover plate 122 has openings formed therein to permit the receptacles 118 to extend therethrough. Preferably, the bottom head assembly 102 includes means for cooling the head assembly from the intense heat produced in the furnace during a heat treating cycle. The cooling means is preferably realized by the combination of the spacer ring 124 and cover plate 122 which defines an enclosed space that functions as a coolant jacket. The coolant jacket preferably includes channels (not show) for directing the flow of a coolant, such as water, across the interior surface of the plate 104. The channels are preferably arranged so that substantially the entire surface of the central area of the plate 104 can be contacted with the coolant. The channel arrangement can be readily designed by those skilled in the art to ensure that the plate 104 is adequately cooled and so that there are no dead-flow spots or eddy currents that would adversely affect the cooling of the bottom head assembly 102. The cover plate separates the cooling channels from the interior of the vacuum furnace when the bottom head assembly 102 is in the closed position relative to the pressure/vacuum vessel body 26.

Figure 12:
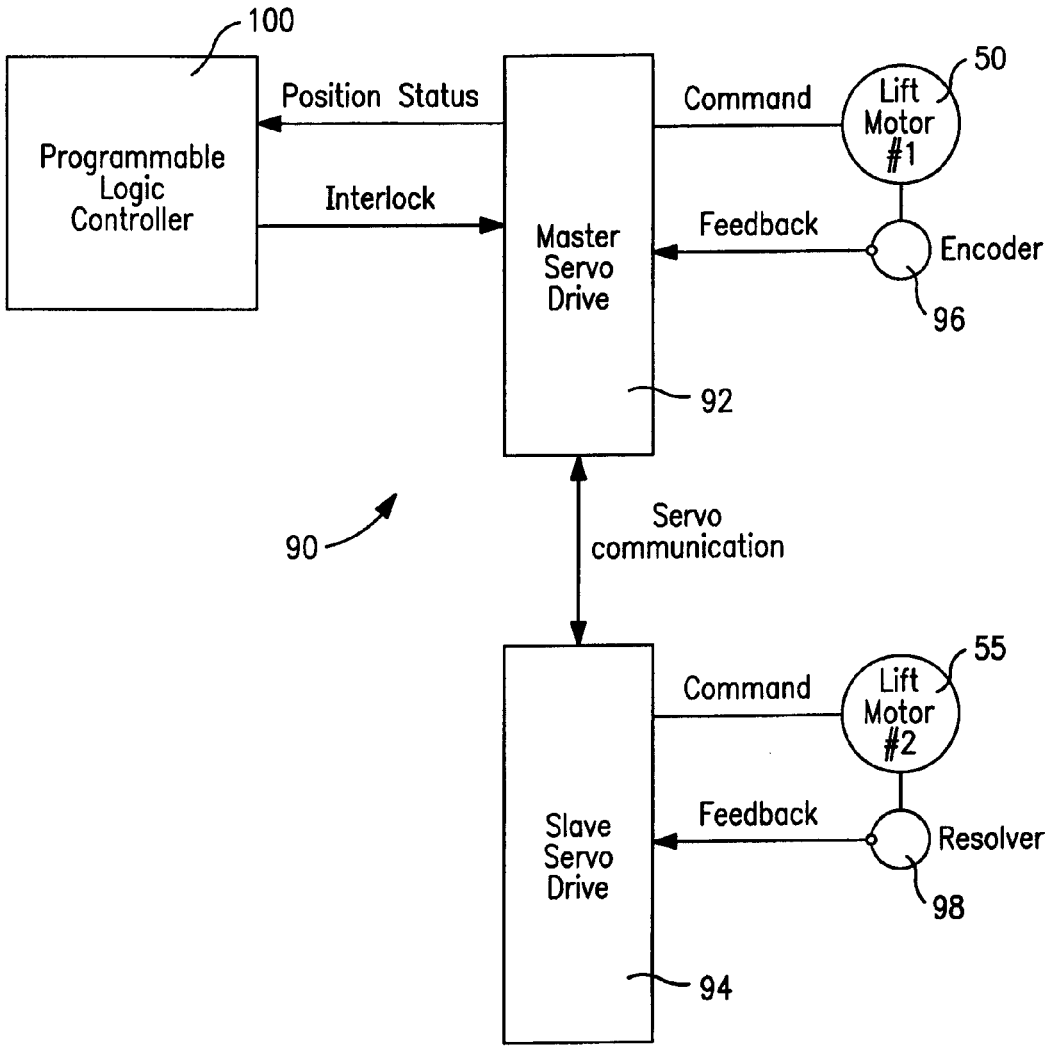
FIG. 12 is a block diagram of a servo-motor control system used in the vertical vacuum furnace of FIG. 1.

Referring now to FIG. 12, there is shown a preferred arrangement for controlling the operation of the lift apparatus according to the present invention. The control system 90 is configured to provide failsafe operation of the lift apparatus by providing a means to interlock movement of the ball screw drives and to synchronize the operation of the lift motors so that the bottom head assembly can be lifted or lowered in a level condition to avoid damage to the bottom head and/or to the lifting mechanism. The control system 90 includes a programmable logic controller (PLC) 100, a master servo drive circuit 92, and a follower servo drive circuit 94. Lift motor 50 is connected to master servo drive circuit 92. An encoder 96 is mechanically coupled to the drive shaft of motor 50. In like manner, lift motor 55 is connected to follower servo drive circuit 94 and a resolver 98 is mechanically coupled to the drive shaft of motor 55.

The PLC 100 includes a processor that is programmed to provide electrical command signals for operating lift motors 50 and 55 to raise or lower the bottom head assembly in response to commands input by a furnace operator. The operator commands may be input to the PLC by any convenient means such as by push buttons or by a keyboard. PLC 100 is programmed to receive status information from the master and follower servo drive circuits indicating whether the bottom head assembly 102 is in its raised or lowered position. When the PLC determines the location of the bottom head assembly, it sends an interlock signal to the servo drive circuits which indicates that movement can be executed. The master servo drive circuit 92 is connected to the PLC 100 for receiving the command signals and to provide first feedback signals to the PLC. The follower servo drive circuit 94 is connected to the master servo drive circuit 92 for receiving the command signals and to provide feedback signals to the PLC through the master servo drive circuit. The PLC is also programmed to monitor the feedback signals from the master and follower servo drive circuits and to provide updated command signals to maintain synchronism between the lift motors 50 and 55. The feedback signals may include indicia of position and/or speed. The encoder 96 is adapted to generate a first feedback signal based on rotation of the drive shaft of lift motor 50. Encoder 96 is connected to the master servo drive circuit 92 for communicating the first feedback signal thereto. In like manner, resolver 98 is adapted to generate a second feedback signal based on rotation of the drive shaft of lift motor 55. Resolver 98 is connected to follower servo drive circuit 94 for communicating the second feedback signal thereto. Preferably, the system includes a homing limit switch (not shown) which is connected to the lift controller. The homing limit switch is positioned to detect when the lifting mechanism is in it fully lowered position and operates to send a signal to the lift controller so that the system zeros itself relative to the position indication.

The servo-drive control system of the present invention provides synchronized movement of the lifting mechanisms on each leg assembly without the need for mechanical linkages including multiple gear boxes, shafts, and couplings, between the lifting mechanisms. The omission of such mechanical linkage results in a significant reduction in the time needed to assemble the vacuum furnace at a customer's facility. The lifting mechanism is much quieter in operation than the known lifting mechanisms for vertical vacuum furnaces. Moreover, the omission of mechanical linkage avoids misalignment problems resulting from long term use. Also, the control system according to this invention is programmable to provide precise lifting/lowering cycles and to be self-limiting with regard to the torque or lifting force the drive mechanisms produce so that accidental damage to any of the elevator components can be avoided. The drives for the lifting mechanisms are self-limiting with regard to the torque or lifting force they produce in order to substantially avoid accidental damage to the elevator components.

The terms and expressions which have been employed are used as terms of description and not of limitation. There is no intention in the use of such terms and expressions of excluding any equivalents of the features or steps shown and described or portions thereof. It is recognized, therefore, that various modifications are possible within the scope and spirit of the invention. Accordingly, the invention incorporates variations that fall within the scope of the invention as described.

The invention claimed is:

1. A vertical vacuum furnace assembly comprising:

a vertically oriented pressure vessel having an opening at a lower end thereof;

a bottom head assembly dimensioned for closing the opening in said pressure vessel;

a support structure comprising first and second preassembled leg assemblies arranged on opposite sides of said pressure vessel and having support arms attached to said pressure vessel; and a control system;

wherein each of said preassembled leg assemblies comprises:

first and second columns;

a floor plate connected to the bottom ends of the first and second columns for attaching said columns to a surface;

a cross beam connecting the first and second columns in spaced relation to each other, said cross beam being positioned at a first distance above said floor plate;

first and second guide channels affixed longitudinally to the first and second columns, respectively, between said floor plate and the cross beam such that said first and second guide channels are on facing surfaces of said first and second columns;

a trolley movably disposed in said first and second guide channels; and a reversible mechanism supported on said cross beam, mechanically connected to said trolley for lifting or lowering said trolley, and electrically connected to said control system whereby said reversible mechanism can be operated to lift or lower said trolley;

wherein the reversible mechanism comprises a threaded shaft rotatably attached at one end to the floor plate, a drive mechanism mounted on the cross beam and connected to the other end of said threaded shaft, and a travelling element movably mounted on said threaded shaft and connected to the trolley;

wherein the trolley comprises a lift assembly that includes first and second side plates arranged in spaced parallel relation, a cross beam interconnecting the first and second side plates at upper ends thereof, a cross bar interconnecting the first and second side plates at lower ends thereof, and a coupling assembly connected to said lift assembly and to the travelling element on said reversible mechanism; and wherein the coupling assembly comprises first and second lifting bars attached at lower ends thereof to the cross bar of said lift assembly, a bracket, and first and second link members pivotably connected between said first and second lifting bars and said bracket.

2. The vertical vacuum furnace assembly as claimed in claim 1 wherein the trolley comprises feet dimensioned and positioned for engagement with said bottom head assembly.

3. The vertical vacuum furnace assembly as claimed in claim 1 wherein said bottom head assembly comprises:

a generally circular steel plate;

a flange formed around the circumference of said steel plate;

first and second lifting beams attached to an external surface of said steel plate; and means attached to an internal surface of said steel plate for supporting a work load on said steel plate.

4. The vertical vacuum furnace assembly as claimed in claim 1 wherein said bottom head assembly comprises a coolant jacket for circulating a coolant along the internal surface of the steel plate.

5. The vertical vacuum furnace assembly as claimed in claim 4 wherein the coolant jacket comprises:

a channel for conducting a coolant along the internal surface of the steel plate within said jacket;

an inlet formed in the steel plate for allowing a coolant to flow into said channel; and an outlet formed in the steel plate distal from said inlet for allowing the coolant to flow out of said channel.

6. The vertical vacuum furnace assembly as claimed in claim 1 wherein said control system comprises:

a first sensor connected to the drive motor on said first leg assembly for generating an electrical signal indicative of a vertical position of the reversible mechanism on the first leg assembly;

a second sensor connected to the drive motor on the second leg assembly for generating an electrical signal indicative of a vertical position of the reversible mechanism on the second leg assembly;

a driver circuit connected to said drive motors and to said first and second sensors; and a processor connected to said driver circuit for receiving position signals generated by said first and second sensors, said processor being adapted for receiving operating commands from an operator, and said processor being programmed for generating command signals in response to said position signals and said operating commands and for transmitting the command signals to said driver circuit, whereby the drive motors can be operated in synchronism.

7. The vertical vacuum furnace assembly as claimed in claim 6 wherein the driver circuit of said control system comprises:

a master drive circuit connected to the drive motor on the first leg assembly, to said first sensor, and to said processor; and a follower drive circuit connected to the drive motor on the second leg assembly, to said second sensor, and to said processor controller.

8. The vertical vacuum furnace assembly as claimed in claim 7 wherein the follower driver circuit is connected to the programmable logic controller through said master driver circuit.

9. A vertical vacuum furnace assembly comprising:

a vertically oriented pressure vessel having an opening at a lower end thereof;

a bottom head assembly dimensioned for closing the opening in said pressure vessel;

a support structure comprising first and second preassembled leg assemblies arranged on opposite sides of said pressure vessel and having support arms attached to said pressure vessel; and a control system;

wherein each of said preassembled leg assemblies comprises:

first and second columns;

a floor plate connected to the bottom ends of the first and second columns for attaching said columns to a surface;

a cross beam connecting the first and second columns in spaced relation to each other, said cross beam being positioned at a first distance above said floor plate;

first and second guide channels affixed longitudinally to the first and second columns, respectively, between said floor plate and the cross beam such that said first and second guides channels are on facing surfaces of said first and second columns;

a trolley movably disposed in said first and second guide channels; and a reversible mechanism supported on said cross beam, mechanically connected to said trolley for lifting or lowering said trolley, and electrically connected to said control system whereby said reversible mechanism can be operated to lift or lower said trolley;

wherein the reversible mechanism comprises a threaded shaft rotatably attached at one end to the floor plate, a drive mechanism mounted on the cross beam and connected to the other end of said threaded shaft, and a travelling element movably mounted on said threaded shaft and connected to the trolley;

wherein the trolley comprises a lift assembly that includes first and second side plates arranged in spaced parallel relation, a cross beam interconnecting the first and second side plates at upper ends thereof, a cross bar interconnecting the first and second side plates at lower ends thereof, and a coupling assembly connected to said lift assembly and to the travelling element on said reversible mechanism; and wherein the cross bar comprises a first bar member and a second bar member arranged in spaced parallel relation to each other on either side of said coupling assembly.

10. The vertical vacuum furnace assembly as claimed in claim 9 wherein the trolley comprises feet dimensioned and positioned for engagement with said bottom head assembly.

11. The vertical vacuum furnace assembly as claimed in claim 9 wherein said bottom head assembly comprises:

a generally circular steel plate;

a flange formed around the circumference of said steel plate;

first and second lifting beams attached to an external surface of said steel plate; and means attached to an internal surface of said steel plate for supporting a work load on said steel plate.

12. The vertical vacuum furnace assembly as claimed in claim 9 wherein said bottom head assembly comprises a coolant jacket for circulating a coolant along the internal surface of the steel plate.

13. The vertical vacuum furnace assembly as claimed in claim 9 wherein said control system comprises:

a first sensor connected to the drive motor on said first leg assembly for generating an electrical signal indicative of a vertical position of the reversible mechanism on the first leg assembly;

a second sensor connected to the drive motor on the second leg assembly for generating an electrical signal indicative of a vertical position of the reversible mechanism on the second leg assembly;

a driver circuit connected to said drive motors and to said first and second sensors; and a processor connected to said driver circuit for receiving position signals generated by said first and second sensors, said processor being adapted for receiving operating commands from an operator, and said processor being programmed for generating command signals in response to said position signals and said operating commands and for transmitting the command signals to said driver circuit, whereby the drive motors can be operated in synchronism.

14. The vertical vacuum furnace assembly as claimed in claim 13 wherein the driver circuit of said control system comprises:

a master drive circuit connected to the drive motor on the first leg assembly, to said first sensor, and to said processor; and a follower drive circuit connected to the drive motor on the second leg assembly, to said second sensor, and to said processor controller.

* * * * *